US005646476A

United States Patent [19]

Aston

[11] Patent Number: 5,646,476

[45] Date of Patent: Jul. 8, 1997

[54] CHANNEL ION SOURCE

[75] Inventor: Graeme Aston, Monument, Colo.

[73] Assignee: Electric Propulsion Laboratory, Inc., Monument, Colo.

[21] Appl. No.: 367,014

[22] Filed: Dec. 30, 1994

[51] Int. Cl.[6] ..... H05H 1/02; F03H 5/00

[52] U.S. Cl. ..... 313/359.1; 313/363.1; 313/154; 313/161; 313/231.01; 315/111.81; 315/111.91; 60/202

[58] Field of Search ..... 313/359.1, 363.1, 313/154, 158, 161, 618, 231.01; 315/111.81, 111.91; 437/930; 60/202

[56] References Cited

U.S. PATENT DOCUMENTS 4,481,062 11/1984 Kaufman et al. ..... 313/359.1
5,475,354 12/1995 Valentian et al. ..... 313/359.1

FOREIGN PATENT DOCUMENTS 1-77764 3/1989 Japan ..... 60/202

*Primary Examiner*—Nimeshkumar Patel

[57] ABSTRACT

A gas ionizable to produce a plasma is introduced into a channel within an ion source and into a hollow cathode embedded within the same ion source. A combined anode and manifold is located at a closed end of the channel and gas is introduced into the channel through the combined anode and manifold and into the hollow cathode. A heater and keeper electrode power supply is used to establish a hollow cathode and keeper electrode plasma. A discharge power supply is used to flow electrons from the hollow cathode in a predominately 180° direction to bombard the channel gas distribution and create a channel discharge plasma. A magnetic field generated by a permanent magnet circuit is concentrated by pole pieces at the open end of the channel in an orientation predominately transverse to the channel axis. Energetic electrons from the hollow cathode interact with the concentrated field to simultaneously ionize the channel gas and accelerates these ions through the open channel to form an ion beam. Simultaneously, electrons from the hollow cathode are emitted in a predominately axial direction to space-charge neutralize the ion beam.

20 Claims, 8 Drawing Sheets

SECTION AA 45
44

16
17

10
25
22
37
40
18
28
41
33
19
12
31
32
30
29
46
26
13
43
42
39
47
24
20
23
14
36
35
34
11
21
38
SECTION BB

SECTION AA

A
B
B
27
37
15
A

CHANNEL ION SOURCE

BACKGROUND OF THE INVENTION

This invention relates to ion sources for use in a vacuum environment. The ion source disclosed is of the type where a propellant, reduced to the gaseous state, is ionized by electron bombardment and accelerated to high energy using an electrodeless acceleration channel. The energetic beam from this type of ion source can be used for a variety of purposes which include surface modification, cleaning, deposition and etching of integrated circuits, solar cells, architectural glass, consumer packaging, and machine tooling. Similarly, the energetic beam from this type of ion source can also be used to provide thrust in space applications where the ion source serves as a propulsion device for spacecraft attitude and orbit maintenance and repositioning functions.

Ion sources for use in a vacuum environment are known. Most ion sources that have been developed for either ground based ion beam processing applications or spacecraft propulsion applications have used electrostatic ion accelerator systems utilizing two or three accelerating electrodes. These electrodes, or grids as they are often called, can contain thousands of precisely aligned apertures, each producing a tiny beamlet all of which combine to give the resulting ion source total ion beam. Ion sources have been developed which produce an energetic ion beam using an electrodeless ion acceleration principle. Attention is directed to U.S. Pat. No. 4,541,890 to J. J. Cuomo et al. and to U.S. Pat. No. 4,862,032 to H. R. Kaufman et al. These prior art designs have low utilization of the propellant gas, produce relatively low energy ion beams, are very sensitive to background vacuum pressure conditions, and depend on a cathode in the ion beam for successful ion acceleration which severely limits cathode lifetime.

A high energy ion beam electrodeless ion source has been developed for space propulsion applications in Russia. A review and reference source for these so called Hall current, or, Stationary Plasma Thrusters (SPT's), is provided in Jet Propulsion Laboratory Publication 92-4 by J. R. Brophy. A Hall current, or SPT, thruster has also been reported in work by K. Komurasaki et al. from Japan. The basic ion acceleration mechanism for the SPT is well known and attention is directed to U.S. Pat. No. 3,309,873 to G. L. Cann. However, the prior art of this type of electrodeless ion source uses either electromagnets or hollow cathodes which are positioned outside the ion source body. This makes for a relatively large volume device which is detrimental for the limited space inside ground based plasma processing vacuum chambers, and for integration to volume constrained spacecraft. Moreover, the prior art Hall current, or SPT ion sources rely on the plasma discharge current passing through the electromagnet solenoids which severely limit their power throttling range due to a rapid drop off in gas ionization efficiency as the accelerating channel magnetic field is necessarily reduced. Similarly, the prior art Hall current, or SPT ion sources experience large erosion of internal source components and significant hollow cathode erosion.

SUMMARY OF THE INVENTION

The present invention provides an improved high current, variable energy ion beam source to satisfy the needs of ground based plasma processing applications and space based spacecraft propulsion applications.

One feature relates to the use of a volume and mass efficient permanent magnet circuit to maintain within an insulated channel a precisely shaped and constant magnetic field for the simultaneous ionization and acceleration of the ion source gas feed.

A further feature of the present invention is to enable provision to alter the shape of the channel, the shape of the channel magnetic field, and the channel magnetic field strength, to accommodate different ion source beam currents, beam energies, beam divergence characteristics and beam patterns.

Still another feature relates to the use of a combined anode and manifold to further minimize source volume and complexity and promote high gas ionization efficiency. This anode/manifold uses a multiple volume gas pressure equalization feature to ensure uniform gas admission into the source channel and subsequently uniform ion beam generation.

Yet another feature is to allow provision on the anode/manifold for gas injection predominately transverse to the ion beam flow to increase gas residence time in the channel and promote higher gas ionization efficiency. Also, provision on the anode/manifold is provided for thin, shaped projections which further confine the gas and increase discharge plasma stability, while also enabling variation of the ion source discharge voltage, and thus, the average ion beam energy. These shaped projections also allow for reliable ion source start up while maintaining a very high channel magnetic field.

An additional feature is the placement of a hollow cathode embedded within the source along the source geometric centerline which provides electrons to simultaneously support the gas ionization and acceleration processes in the source channel, while also providing electrons to space-charge neutralize the emitted ion beam. Such placement also enables the hollow cathode to perform these functions with a minimal use of propellant gas.

A further feature of this hollow cathode placement is to minimize the source volume, mass and complexity while increasing its robustness by removing the hollow cathode to a location away from the energetic ion beam.

Still a further feature of the embedded hollow cathode placement is to allow ion source operation for long times on reactive gases in the channel such as oxygen, with no concern of such detrimental gas ion products reaching the embedded, centrally located hollow cathode which can function using inert gases such as argon, krypton or xenon.

Another feature of the present invention is the use of insulator shielding rings surrounding the insulator channel to shield the magnetic circuit pole pieces from ion sputter erosion and to further isolate the keeper electrode and hollow cathode from energetic ion bombardment.

An additional feature is the ability of the ion source to function on only a single discharge supply due to the central location of the hollow cathode which can function in a self-heating mode whereupon heater power to the hollow cathode and keep-alive current to the keeper electrode can be reduced to zero.

A final feature is the shape and aspect ratio of the insulated channel, its termination, and its integration to the pole piece insulator shielding rings to enable the ability to accommodate a high channel plasma density, and a high degree of ion acceleration, in a minimal volume while mitigating thermal stress and heat rejection requirements.

These and other advantages and attainments of the present invention will become apparent to those skilled in the art upon a reading of the following detailed description when taken in conjunction with the drawings wherein is shown and described an illustrated embodiment of the invention.

DETAILED DESCRIPTION OF THE PREFERRED EMBODIMENTS

Figures 1A, 1B, 1C, 1D, 1E:
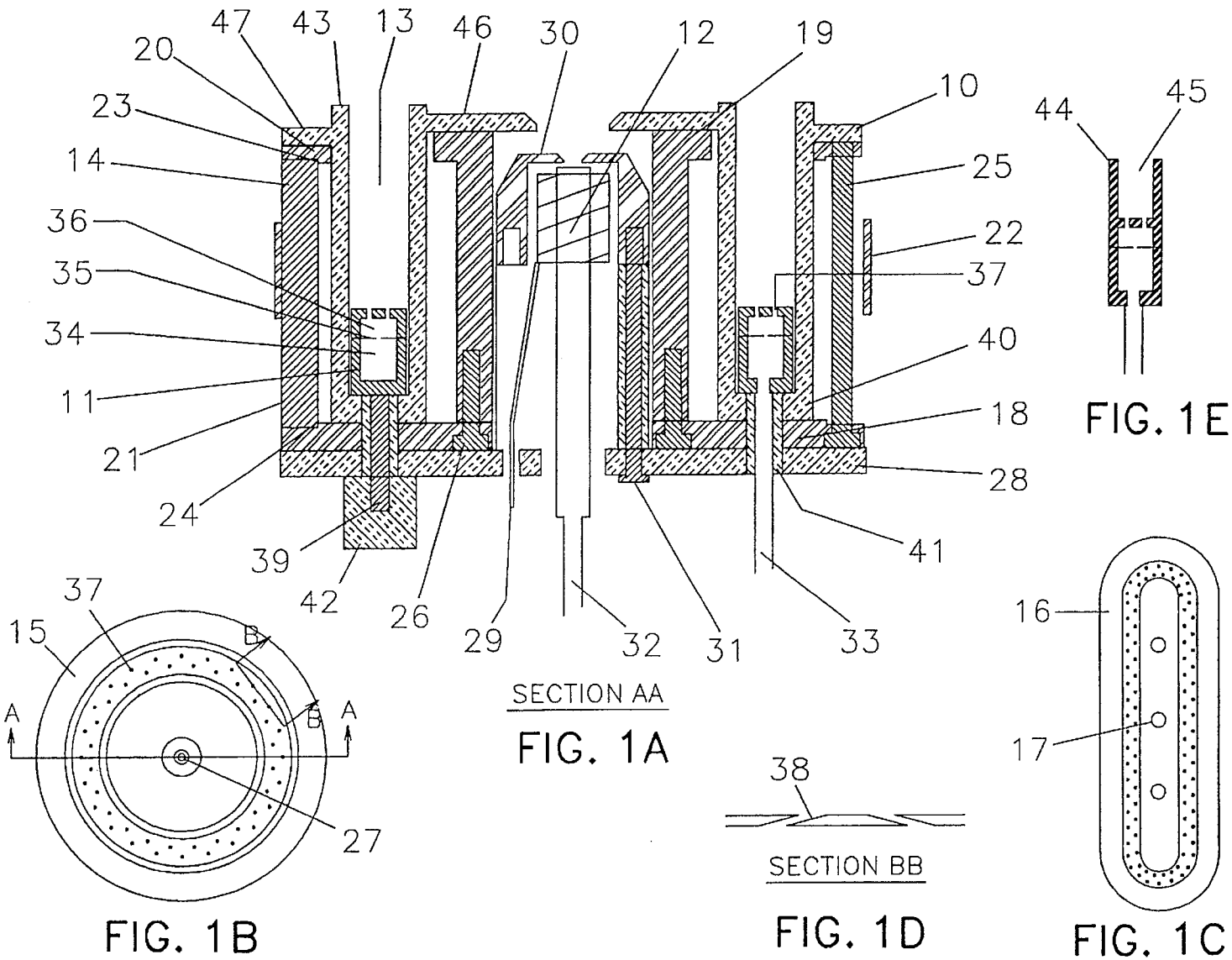
FIG. 1A is a cross-sectional view of a circular channel ion source representing one specific embodiment of the present invention.
FIG. 1B is a plan view of the circular channel ion source in FIG. 1A.
FIG. 1C is a plan view of another embodiment of the invention showing a predominately linear channel ion source.
FIG. 1D is a section view of the exit holes in the anode/manifold of FIG. 1A and FIG. 1B showing one embodiment to promote a spiral gas injection.
FIG. 1E is a section view of one embodiment of the anode/manifold of FIG. 1A having shaped projections.

Referring to FIG. 1A, a channel ion source 10 according to the present invention is comprised of an anode/manifold 11, a hollow cathode 12, an ionization and acceleration channel 13, and a permanent magnet circuit 14. As shown in FIG. 1B, these major components of the channel ion source 10 are normally arranged in a cylindrical source geometry 15. However, as also shown in another embodiment in FIG. 1C, the channel ion source 10 can be made in a linear, or race track, configuration 16. In the case of a linear channel ion source 16, multiple hollow cathodes 17 may be required to ensure that adequate ion beam uniformity and ion beam current levels are achieved.

The permanent magnet circuit 14 of FIG. 1A consists of a magnetic permeable structure comprising a backing plate 18, an inner hollow pole piece 19, an outer ring pole piece 20, and, spaced around the outer circumference of backing plate 18 and pole piece 20 are permanent magnets 21 held in place by a non-magnetic band 22 against steps 23 and 24. Non-magnetic bolts 25 located around the periphery of backing plate 18 and pole piece 20, and situated between the permanent magnets 21, secure the backing plate 18, permanent magnets 21, and outer ring pole piece 20 together. Inner pole piece 19 is shown in FIG. 1 attached to backing plate 18 using non-magnetic bolts 26, but this component has also been manufactured as a single piece comprising backing plate 18 and inner pole piece 19. The magnets 21 in the ion source 10 may be either rods, bars, sectors, or one single thin ring with the magnets 21 magnetized through their long direction and aligned around the ion source 10 periphery so that a common magnet pole is at the downstream, or open channel, end of the ion source 10 and a common magnet pole is at the upstream, or closed channel, end of the ion source 10. Uniform magnetization of the permanent magnets is critical since azimuthal variations in the strength and shape of the magnetic field in the channel 13 create different degrees of gas ionization and subsequent ion beam non-uniformities. Tests have shown that azimuthal magnetic field non-uniformity in the channel 13 should be of order ±5% or less.

The hollow cathode 12 is embedded within the circular source center 27, or embedded along the long axis of the linear source 16 in multiple units as required 17. The use of hollow cathodes 12 as electron emitters for ion sources is known. The hollow cathode 12 is attached to the alumina electrical insulator ion source mounting plate 28 which simultaneously provides electrical isolation and mechanical support for the ion source components. Similarly, any necessary hollow cathode heater lead 29 also passes through the mounting plate 28 to provide support add electrical isolation for this input power connection. An enclosed keeper electrode 30 is used for the hollow cathode 12 in the ion source 10. Use of an enclosed keeper electrode 30 with a hollow cathode 12 is known. Simultaneous support and electrical connections 31 to this keeper electrode 30 pass through the insulated mounting plate 28 to maintain electrical isolation of the keeper electrode 30 from the hollow cathode 12 and from the inner pole piece 19.

Gas is injected into the ion source 10 at the base of the hollow cathode 32 and in the main gas inlet tube 33 which is attached to the non-magnetic, high electrical conductivity, anode/manifold 11. The embedded central hollow cathode location 27 results in only 5% or less of the total ion source 10 gas flow being required to operate the hollow cathode 12 with the remaining 95% or more gas flow passing into the anode/manifold 11. Stable ion source 10 operation and uniform ion beam formation critically depend upon the admission into the channel 13 of an azimuthally uniform gas pressure and flow rate from the anode/manifold 11. This is achieved using only one gas inlet tube 33 into the anode/manifold 11, and thereby at a minimum use of parts, by having the gas first enter a gas distribution plenum 34. In plenum 34 the gas is distributed around the annular anode/manifold 11. The gas pressure in plenum 34 assumes a fairly uniform pressure and passes into downstream plenum 34 via small centrally spaced holes in diaphragm 35 none of which are aligned with gas inlet tube 33. The holes in diaphragm 35 are not aligned with the downstream plenum 36 gas exit holes 37 which permits the gas pressure in downstream plenum 37 to reach a condition of complete azimuthal pressure uniformity with corresponding uniform gas admission into the annular channel 13. Maximum ion source 10 efficiency is achieved when all of the gas entering the channel 13 is ionized and accelerated into an ion beam. The probability of ionizing each gas atom is a maximum when the gas atoms reside in the channel 13 for the longest time possible. Injection apertures 37 may be aligned along the channel 10 axis or aligned to provide a predominately azimuthal 38 rather than axial injection velocity to the gas atoms and thus promote a spiral flow of these gas atoms in the channel 13 and thereby increase their residence time and probability of ionization.

Assembly of the ion source 10 is by several non-magnetic threaded rods 39, such as 300 series stainless steel, which are evenly spaced around the base of the anode/manifold 11. These threaded rods 39 pass through the base of the channel insulator 40 and the magnetic permeable backing plate 18 and the alumina ion source mounting plate 28. Alumina, or similar high quality insulator tubes 41 isolate these threaded rods 39 from the backing plate 18 and ceramic cap nuts 42 cover the ends of these threaded rods 39 and securely clamp the anode/manifold 11, cup shaped channel electrical insulator 43, backing plate 18, and ion source mounting plate 28 together. The cup shaped channel electrical insulator 43 also comprises an outer ring component 47 to cover the outer pole piece 20 and an inner ring component 46 to cover the inner pole piece 19.

Figure 2:
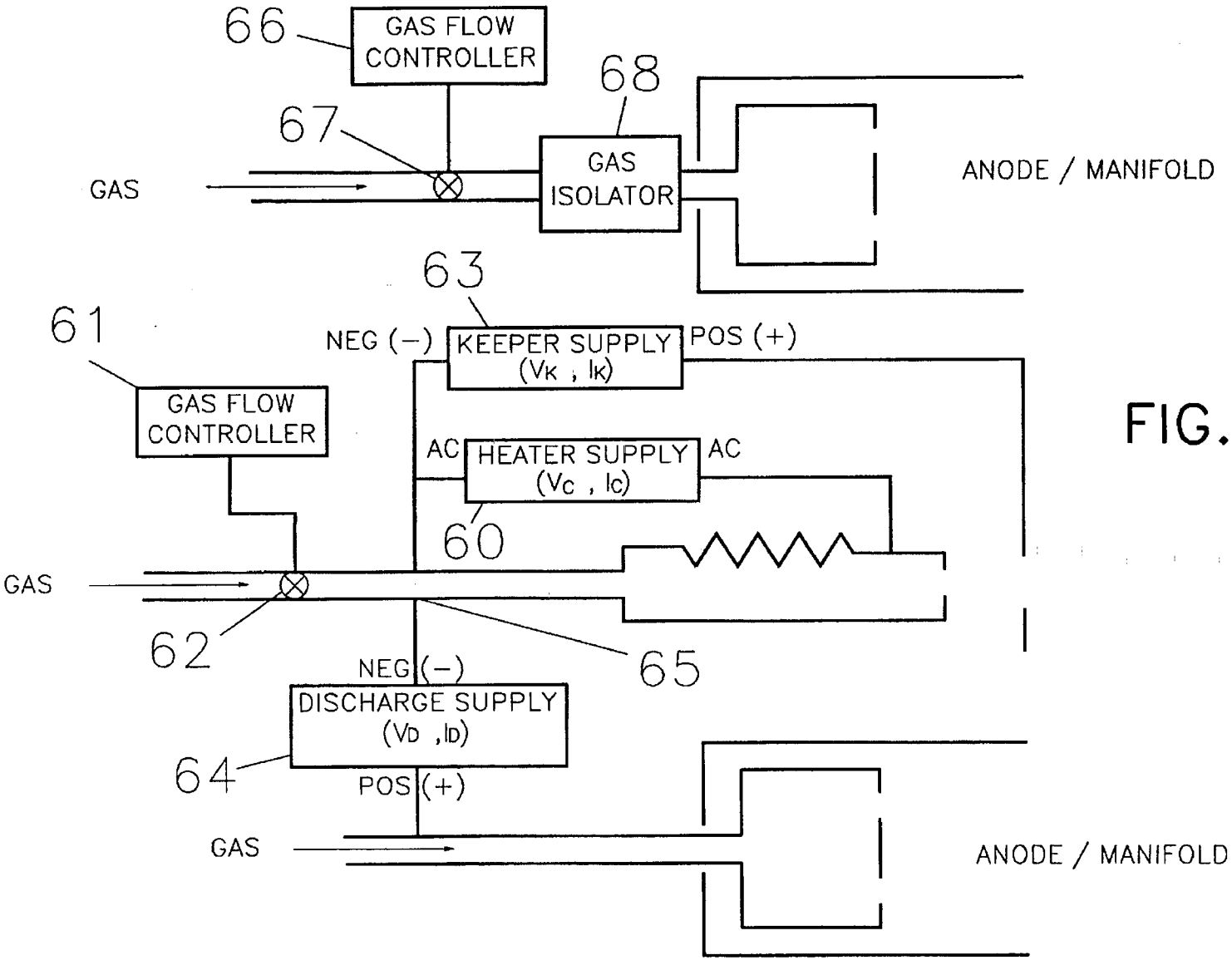
FIG. 2 is a schematic diagram of electrical energizing circuitry and gas flow paths of the circular channel ion source in FIG. 1A.

FIG. 2 shows schematically the electrical input power connections and gas inlet connections for ion source 10. A heater supply 60 provides an alternating current $I_c$ at a voltage $V_c$. to the hollow cathode 12. Other types of hollow cathodes may be used in which the heater supply 60 provides a direct current and voltage. Hollow cathode 12 is typical of units in wide spread use in the plasma processing industry and the electric space propulsion industry. Gas flow to the hollow cathode 12 is maintained by a gas flow controller 61 which adjusts a valve 62 in the hollow cathode gas inlet line 32. The gas flow controller 61 and adjustable valve 62 are known. A keeper supply 63 provides a positive voltage $V_k$ and a direct current $I_k$ to the keeper electrode 30. Anode/manifold 11 is connected to the positive potential of discharge supply 64 providing a voltage $V_D$ and a direct current $I_D$ whose return circuit is connected to the return circuits of the heater supply 60 and the keeper supply 63 which are in turn connected to a common point 65 on the hollow cathode 12. For plasma processing applications, the hollow cathode 12 common electrical connection 65 is connected to system ground and the ion source 10 permanent magnet circuit 14 is also connected to system ground. For space propulsion applications, the hollow cathode 12 common electrical connection 65 is connected to spacecraft common and the ion source 10 permanent magnet circuit 14 is also connected to spacecraft common.

Gas flow to the anode/manifold 11 is maintained by a gas flow controller 66 which adjusts a valve 67 in the anode/manifold 11 gas inlet 33. The gas flow controller 66 and adjustable valve 67 are known. Isolator 68 electrically isolates the high positive potential of the anode/manifold 11 from the gas inlet 33 and the adjustable valve 67 and flow controller The gas isolator 68 is known.

Figure 3:
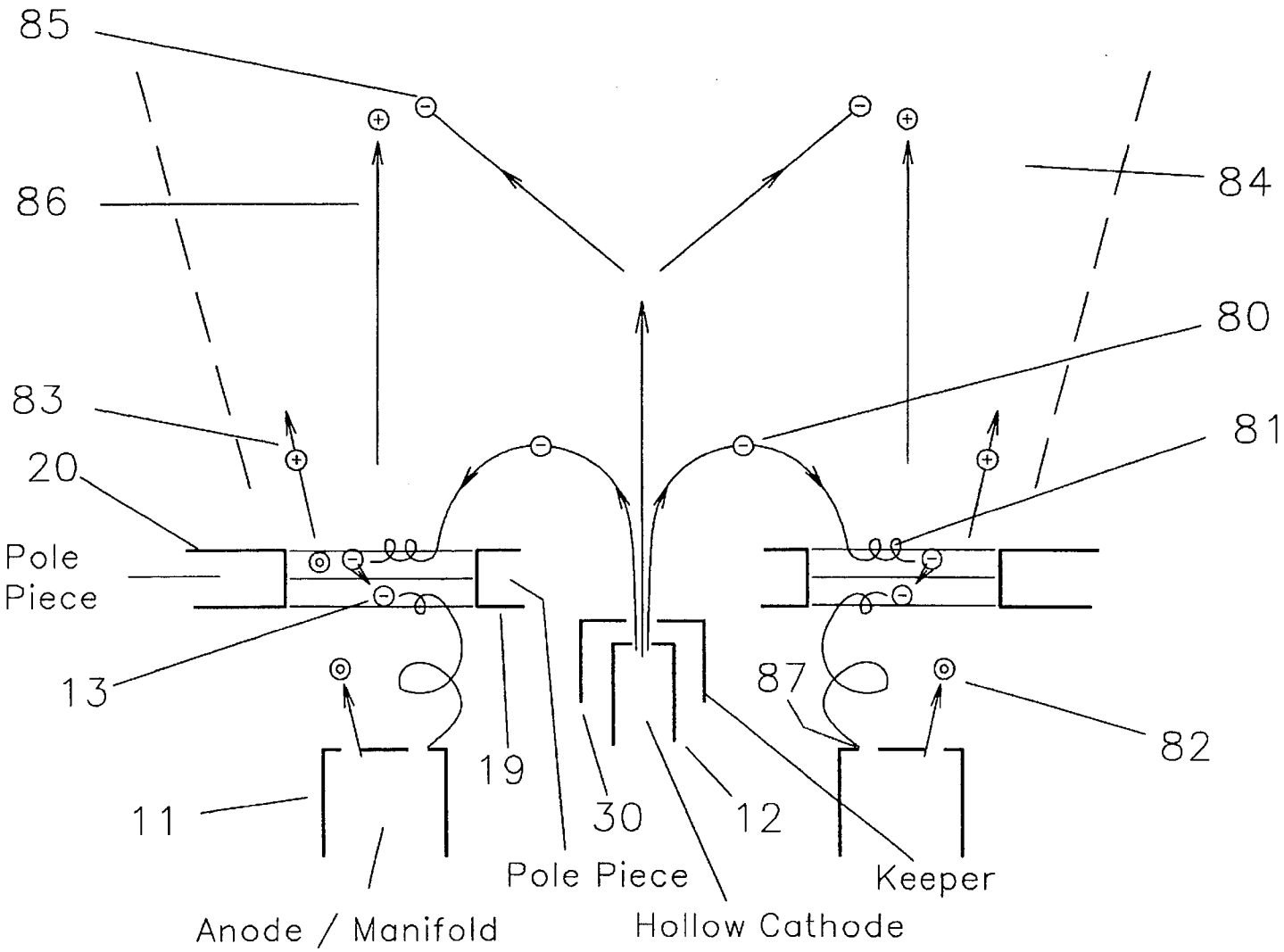
FIG. 3 is a schematic representation of the plasma processes occurring to ionize, accelerate and space-charge neutralize the ion beam of the circular channel ion source in FIG. 1.

FIG. 3 is a schematic representation of the plasma processes occurring to ionize, accelerate and space-charge neutralize the ion beam from the ion source 10. Neutral atoms or molecules of the ion source 10 gas are indicated by the letter "o", electrons by the sign "–" and ions by the sign "+". Operation of the ion source 10 is initiated by flowing gas through the hollow cathode 12 and turning on the heater supply 60 to create a copious source of thermal electrons within the hollow cathode 12. Applying an adequate positive voltage $V_k$ to the keeper electrode 30 from the keeper supply 63 creates a hollow cathode 12 to keeper electrode 30 plasma discharge by a process which is which is well known. Electrons 80 from the hollow cathode 12 and keeper electrode 30 plasma discharge are attracted to the anode/manifold 11 by a positive potential $V_D$ from the discharge supply 64. These energetic electrons enter the channel 13 and are confined by a small cyclotron radius to the strong, predominately radial, magnetic field lines 81 between the inner pole piece 19 and the outer pole piece 20. Neutral atoms or molecules 82 admitted into the channel from the anode/manifold 11 undergo inelastic collisions with energetic electrons confined by the predominately radial field lines 81 and are ionized 83. These inelastic electron collisions with the neutral atoms or molecules 82 aid the electrons 80 in crossing the strong predominately radial magnetic field lines towards the positive potential anode/manifold 11 where they eventually join the surface 87 of the anode/manifold 11 to complete the current path to the discharge supply 64. The confinement of the electrons 80 to the strong magnetic field lines 81 in the channel 13 means that the confined electrons 80 act as virtual negative accelerator electrodes for the ions 83 which upon being created are accelerated through these virtual electrodes in a predominately axial direction out of the channel 13. In effect, the strong confinement of the electrons 80 to the field lines 81 creates a predominately axial potential distribution where the lines of equipotential approximate closely the shape and position of the magnetic field lines 81 in the channel 13. The channel 13 magnetic field lines closest to the anode/manifold 11 have a positive potential near that of the anode/manifold 11, while the magnetic field lines at the exit of the channel 13 have a potential near that of the hollow cathode 12. It is important to note that this ion acceleration mechanism is essentially electrostatic in nature. Moreover, since ion acceleration is through a quasi-neutral plasma via virtual electrodes defined by electrons confined to magnetic field lines, there is no space-charge limit to the accelerated ion current density as is the case in an ion source using discrete electrodes, or grids. Movement of the electrons 80 to the anode/manifold 11 results in a generally azimuthal motion of these electrons 80 around the channel 13 as a result of the action of the predominately radial magnetic field lines This general azimuthal motion of electrons 80 around the channel 13 is referred to as a Hall current. Similarly, the ions 83 formed in the channel 13 are also acted on by the predominately radial magnetic field lines 81 as they are accelerated to the channel 13 exit. However, because the ions 83 are so much more massive than the electrons 80, the azimuthal velocity they receive is relatively low compared to their axial velocity. Nevertheless, the small azimuthal, or Hall, velocity component imparted to the ions 83 results in a small torque on the ion source 10 due to the net small azimuthal, or spiral, velocity component on the ion beam To maintain space-charge neutralization of the ion beam 84, a population of electrons 85 is emitted from the centerline of the hollow cathode 12 and joins the beam ions 86 so that an equal number of ions 86 and electrons 85 leave the ion source 10. The space-charge neutralization of the ion beam 84 occurs as a consequence of strong electron attracting forces in the ion beam. To ensure that the ion beam 84 from the ion source 10 is well neutralized requires that there is adequate gas flow through the hollow cathode 12 so that the plasma discharge between the hollow cathode 12 and the keeper electrode 30 is conductive enough to support an emission of electrons from the hollow cathode 12 sufficient to provide the required electron current to the anode/manifold 11 and the electron current to the ion beam 84.

The hollow cathode 12 is embedded in the ion source 10 center. However, the hollow cathode 12 position on the ion source 10 axis is not arbitrary. An axial gradient in magnetic field strength occurs along the ion source 10 axis as a consequence of the permanent magnet circuit 14. Placing the hollow cathode 12 too deep inside the ion source 10 exposes it to a strong axial magnetic field gradient which inhibits electron flow 80 from the hollow cathode 12 to the anode/manifold 11. Similarly, placing the hollow cathode too far out of the ion source 10 exposes the hollow cathode 12 and keeper electrode 30 surfaces to beam ion bombardment and erosion. The appropriate relative positions of the hollow cathode 12, anode/manifold 11, and permanent magnet circuit 14 is shown in FIG. 1A.

Embedding the hollow cathode 12 in the ion source 10 center results in a highly conductive plasma electron current path 80 to the ion source channel 13 while effectively preventing energetic channel ions 83 from reaching the hollow cathode 12. This feature enables the ion source 10, when used for ground based plasma processing applications, to be operated with a reactive gas such as oxygen in the channel 13, and an inert gas such argon in the hollow cathode 12, without resulting in the chemically reactive oxygen gas and ion species migrating to the hollow cathode 12 and impairing the operation and lifetime of the hollow cathode 12.

Embedding the hollow cathode 12 in the ion source 10 center maximizes the symmetry and efficiency of the electrostatic coupling between the hollow cathode 12 and the anode/manifold 11 and thus maximizes the efficiency with which electrons 80 are drawn from the hollow cathode 12 for a given unit of gas flow through the hollow cathode 12. The ion source 10 requires 5% or less gas flow through the hollow cathode 12 with the remaining 95% or more gas flow passing through the anode/manifold 11. Since the total efficiency of the ion source 10 depends directly on the ionization and acceleration of the channel 13 gas atoms, the ion source 10 has a high operating efficiency due to the embedded hollow cathode 12 feature.

An inner ring insulator 46 and outer ring insulator 47 are used to prevent the beam ions 83 from seeing the common point 65 potential of the inner pole piece 19 and outer pole piece respectively. Without insulators 46 and 47, the beam ions 83 are accelerated to the inner pole piece 19 and the outer pole piece 20 where they cause ion sputter erosion. In addition, the inner ring insulator 46 is also sized and positioned to prevent such beam ion 83 erosion from occurring on the enclosed keeper electrode 30.

Experimental emissive probe measurements of the plasma potential in the ion beam 84 emanating from the ion source 10 show that the ion beam 84 plasma potential is only a few volts positive of the common point 65 of the hollow cathode 12. These results verify the efficiency of the embedded hollow cathode 12 in providing an electron current 85 adequate to properly space-charge neutralize the ion beam 84.

Thin, shaped projections 44 have been incorporated into the anode/manifold 11 and provide an intermediate gas pressure regime 45 between the exit of the anode/manifold and the channel 13 to promote higher gas ionization efficiency. Such projections 44 also increase discharge plasma stability in the channel 13 and provide a mechanical means of adjusting the voltage $V_D$ of this discharge plasma by bringing the influence of the anode/manifold 11 potential closer to the ion acceleration region between the inner pole piece 19 and the outer pole piece 20 without substantially decreasing the volume of the ionization and acceleration channel 13. These shaped anode/manifold 11 projections 44 also allow for relatively low discharge voltage $V_D$ ignition of the channel 13 discharge plasma while maintaining a high magnetic field strength in the channel 13.

Figure 4A:
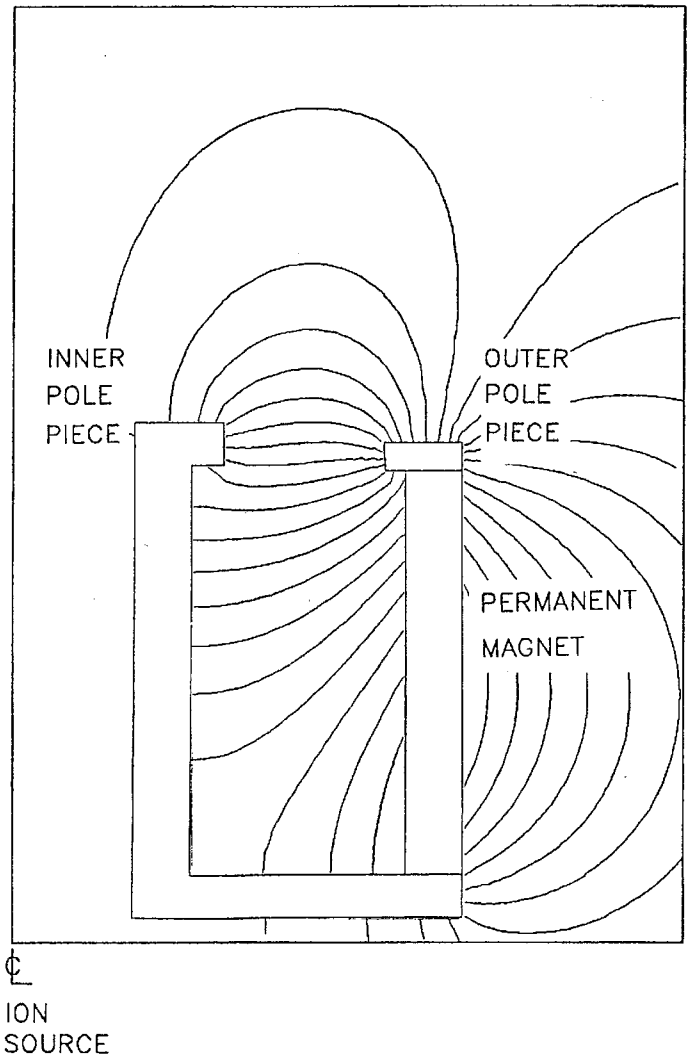
FIG. 4A is a cross section of the theoretically calculated magnetic flux lines in and around the annular channel of one embodiment of the circular channel ion source in FIG. 1A having permanent magnets located around the outside of the channel only.

FIG. 4A shows a half section view of the theoretically estimated shape of the magnetic field distribution of the permanent magnet circuit 14 used in the ion source 10 for one embodiment wherein permanent magnets are used only on the outside of the channel 13. Acceleration of the ionized gas in the channel 13 occurs primarily between the faces of the inner pole piece 19 and the outer pole piece 20 where the magnetic field lines are predominately radial and of maximum intensity. For a 10-cm over-all diameter ion source 10 capable of processing a discharge supply 64 input power of about 1 kW, the radial magnetic field intensity can be of order 1,000 Gauss. Reducing the strength of this radial field by reducing the number of permanent magnets 21 reduces the magnitude of the discharge voltage $V_D$ that can be supported in the channel 13 and thus reduces the energy of the beam ions 86. However, reducing the radial magnetic field strength allows a greater electron current 80 to pass from the hollow cathode 12 to the anode/manifold 11 and thus permits more beam ions 86 to be produced. Hence, for a given ion source 10 discharge supply 64 input power, a higher channel 13 radial field strength means a lower current but higher energy ion beam 86, while a lower channel 13 radial field strength means a higher current but lower energy ion beam 86.

Figure 4B:
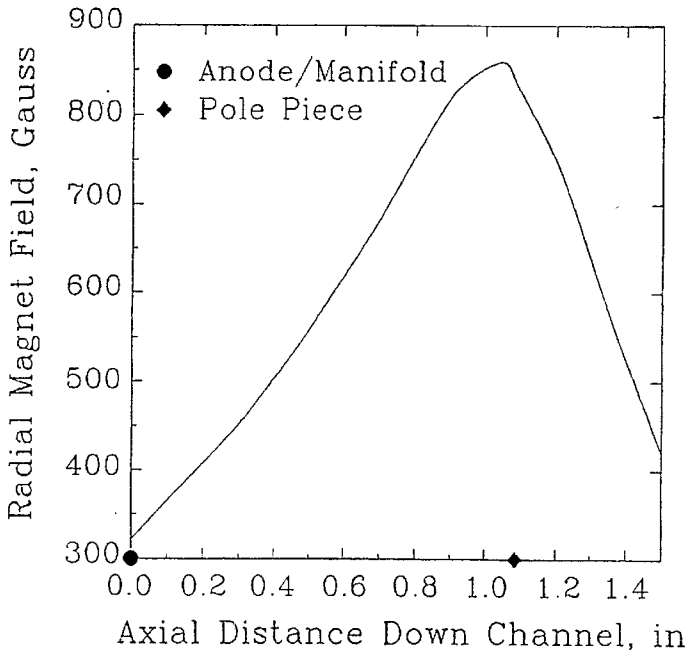
FIG. 4B is a plot of the theoretically calculated variable gradient axial magnetic field through the ion source channel of one embodiment of the circular channel ion source in FIG. 1A having permanent magnets around the outside of the channel only.

The channel 13 ion acceleration process in the ion source 10 also depends on the axial variation of the radial magnetic field strength which is shown plotted in FIG. 4B from the theoretically calculated results of FIG. 4A. Increasing the axial length of the inner pole piece 19 and the outer pole piece 20 reduces the gradient of this axial magnetic field variation, which increases the axial extent of the ion accelerating potential distribution tending to cause a greater ion 83 loss to the insulated channel interior surfaces 43. Similarly, increasing the length of the insulated channel 43 much beyond the axial extent of the inner pole piece 19 and the outer pole piece 20 also results in an increased beam ion 83 loss to the insulated channel 43 and a drop in ion source 10 efficiency.

Figure 4D:
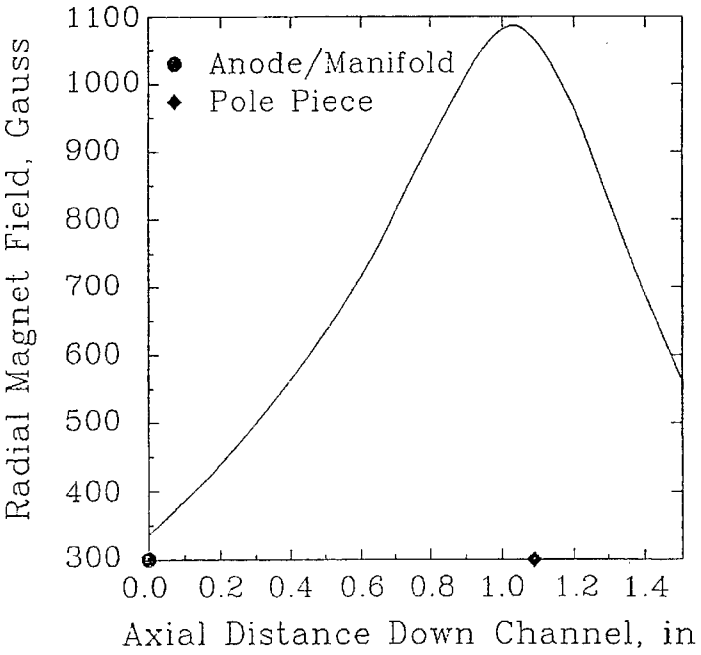
FIG. 4D is a plot of the theoretically calculated variable gradient axial magnetic field through the ion source channel one embodiment of the circular channel ion source in FIG. 1A having permanent magnets around both the inside and outside of the channel.
Figure 4C:
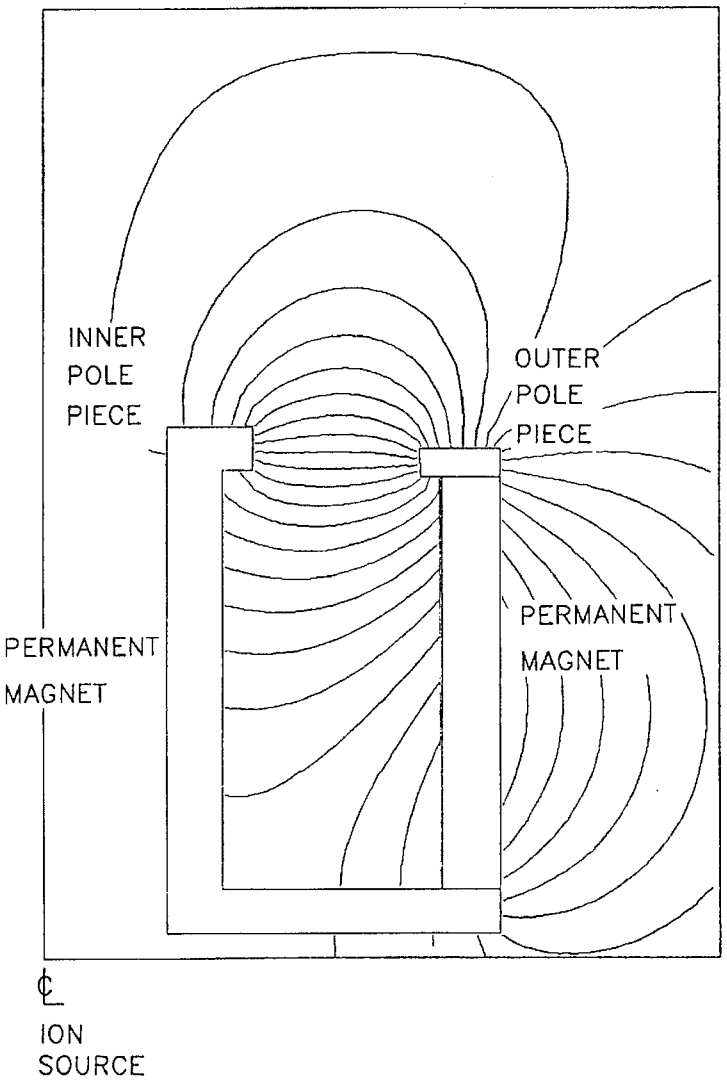
FIG. 4C is a cross section of the theoretically calculated magnetic flux lines in and around the annular channel of one embodiment of the circular channel ion source in FIG. 1A having permanent magnets around both the inside and outside of the channel.
Figure 5:
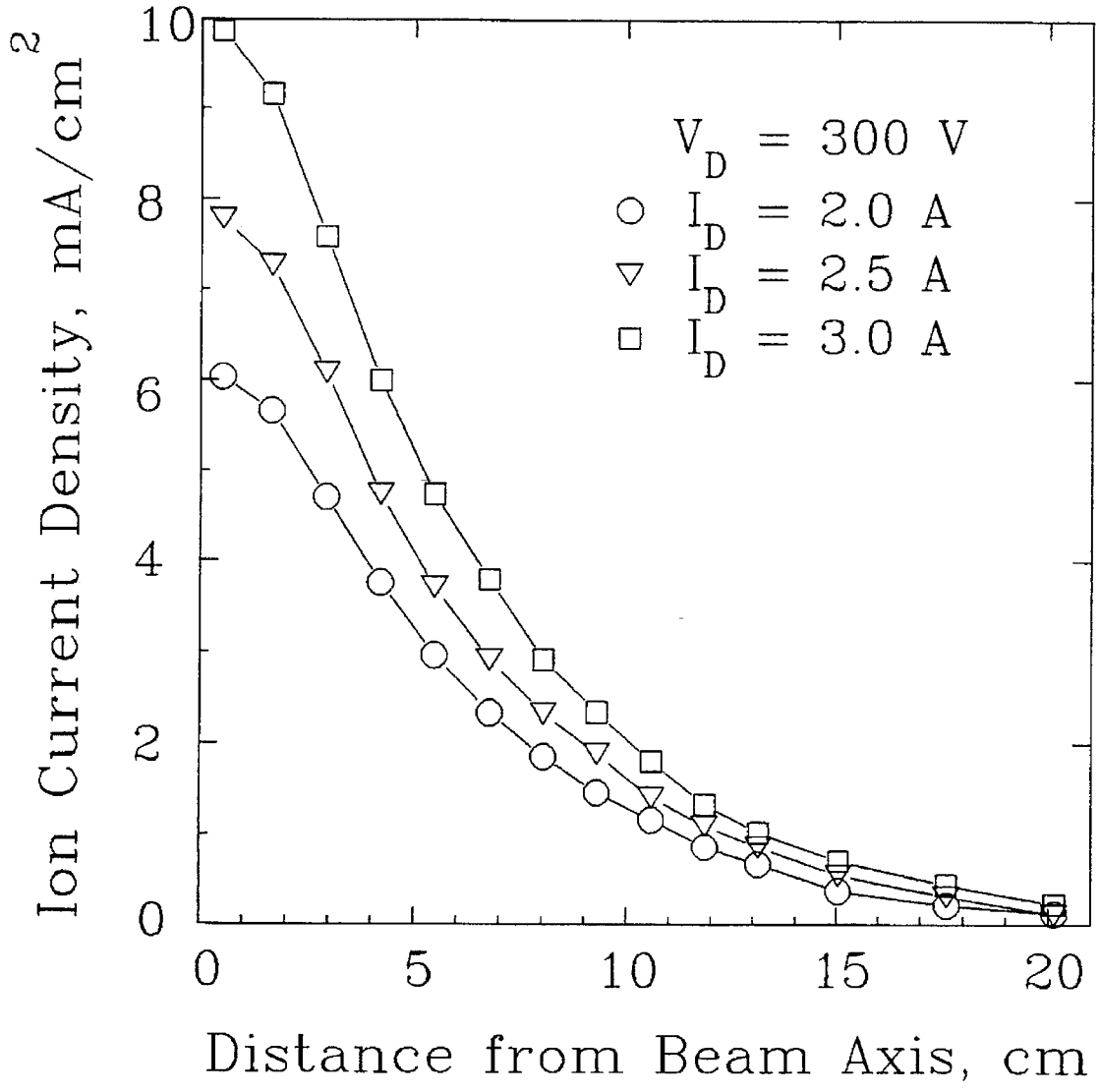
FIG. 5 is a graphical representation of the experimentally measured ion beam current density distribution of one embodiment of the circular channel ion source of FIG. 1.
Figure 6:
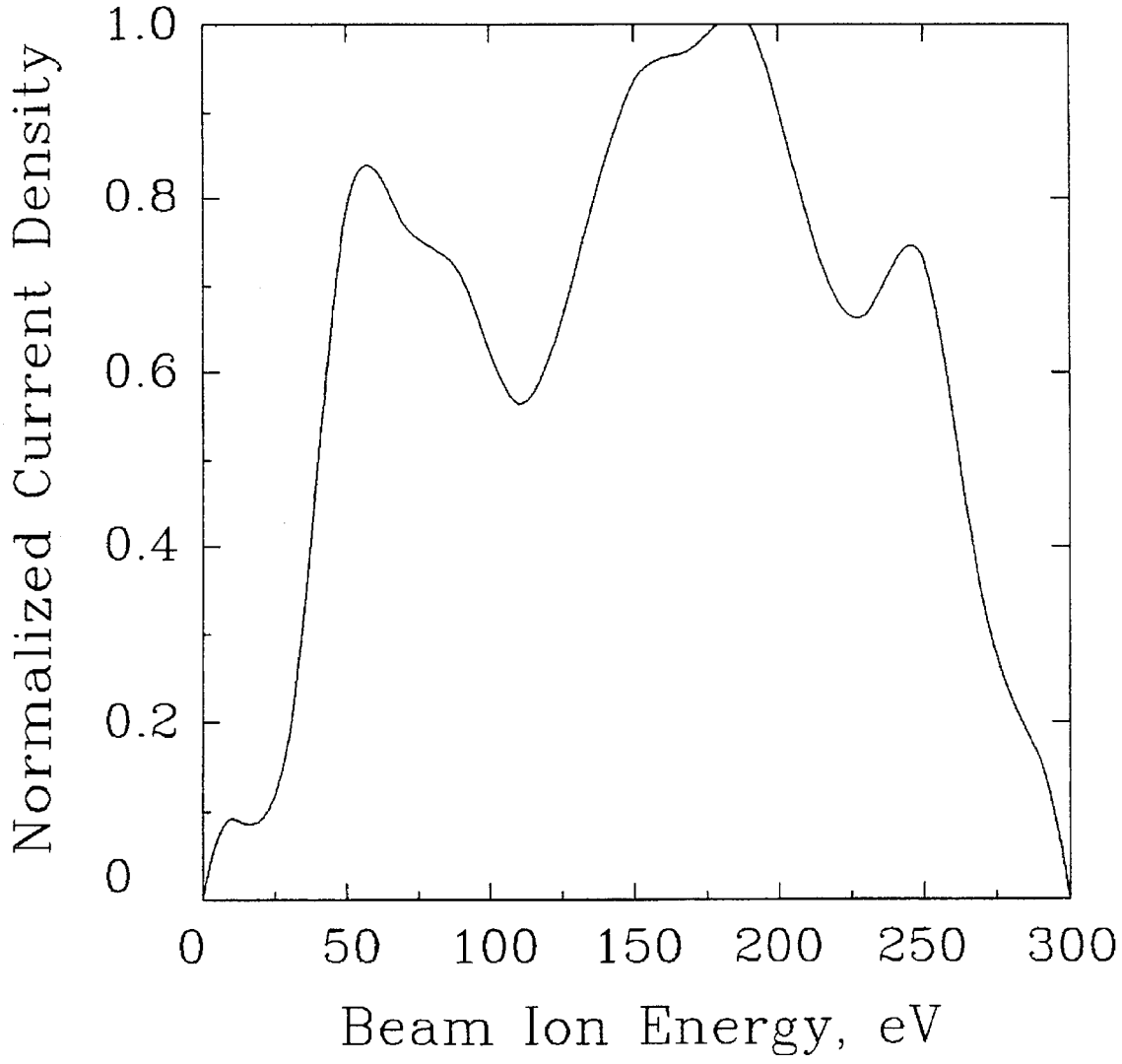
FIG. 6 is a graphical representation of the experimentally measured ion beam energy distribution of one embodiment of the circular channel ion source of FIG. 1.
Figure 7:
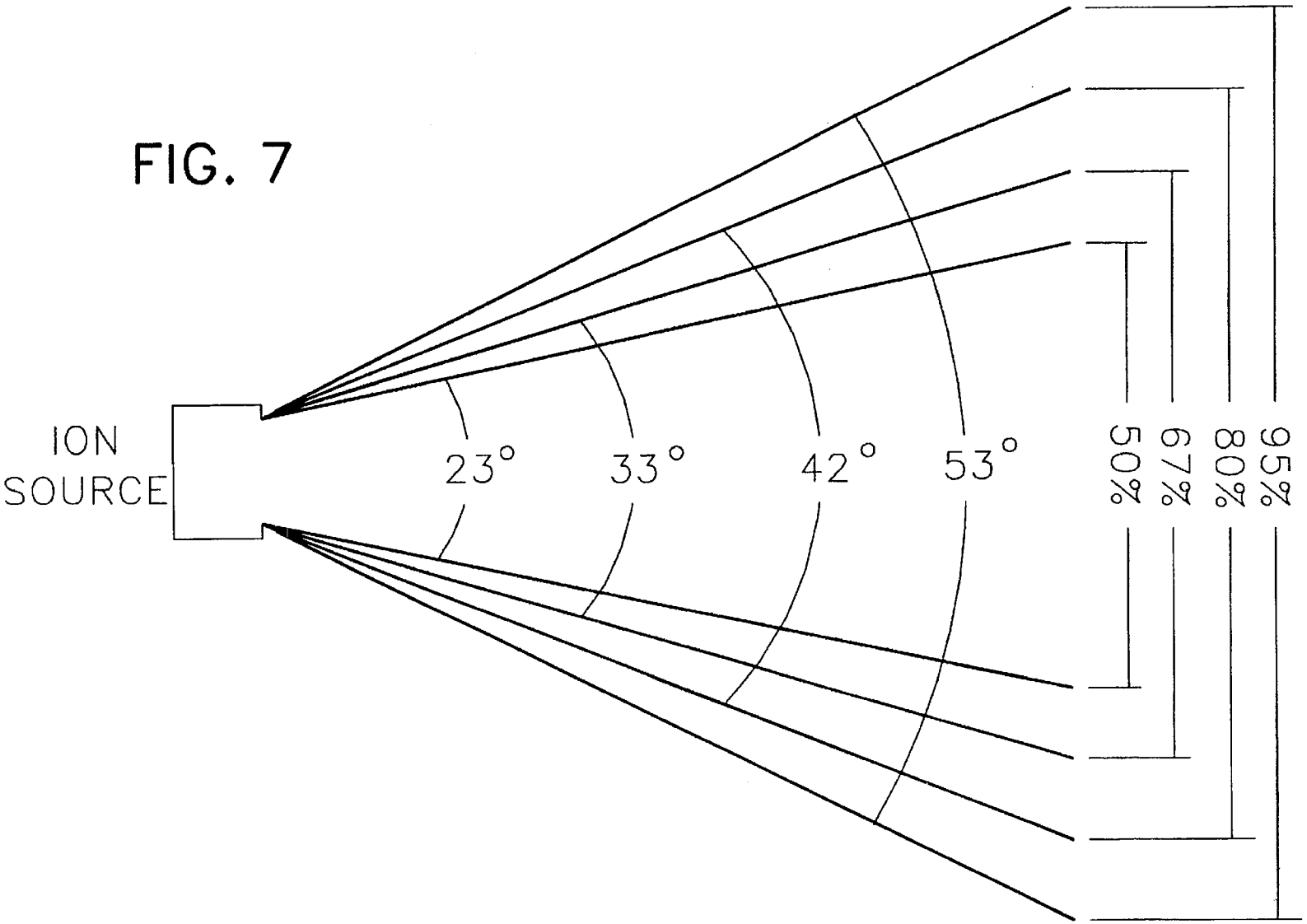
FIG. 7 is a graphical representation of the experimentally measured ion beam divergence characteristics of one embodiment of the circular channel ion source of FIG. 1.

FIG. 4C and FIG. 4D illustrate another embodiment of the ion source 10 wherein permanent magnets are used both around the outside of the channel 13 and around the inside of the channel 13. The addition of permanent magnets to the inside of the channel 13 of the ion source 10 permits an increased magnetic field strength between the pole pieces 19 and 20 and a further means of effecting changes in the shape of the magnetic field and the axial gradient of the magnetic field in the ionization and acceleration region of the channel 13. Characteristics of the ion beam 84 from the ion source 10 have been experimentally measured. A Guard ring Faraday probe has been used to measure the ion current density distribution in the ion beam 84 from one embodiment of the ion source 10 as depicted in FIG. 5 operating on xenon gas at an ion beam probing location 22 cm downstream of the ion source 10 channel 13 exit in the direction of beam ion flow. Half ion beam current density profiles are shown in FIG. 5 because Faraday probe measurements showed the beam 84 from several embodiments of the ion source 10 was symmetric about the ion source 10 axis. It is found that the ion beam current emitted from the ion source 10 for a given admitted gas flow is less with decreasing gas atomic weight since the residence time of lighter gases in the channel 13 is less, and the ionization cross sections of lighter gases are less while their ionization potentials tend to be greater. The kinetic energy distribution amongst the beam ions 83 for one embodiment of the ion source 10 has been measured experimentally with a retarding potential energy probe. FIG. 6 shows the measured beam ion 83 energy distribution for operation of ion source 10 on argon gas at a location 22 cm downstream from the ion source 10 channel 13 exit. On lighter atomic weight gases such as argon, the average beam ion 83 energy is in the range 50%–60% of the discharge voltage $V_D$. Heavier atomic weight gases such as xenon have average bean ion energies in the range of 60%–70%, and greater, of the discharge voltage $V_D$. For a given ion source 10 geometry the discharge voltage has been increased to approximately 500 V by reducing the gas flow into the anode/manifold 11 and thus decreasing the ion beam current for a given ion source 10 input power. Ion source 10 operation at these high discharge voltages and beam energies places added stress on the insulating properties of the channel insulator 43 and on the ion sputter resistance requirements of the channel insulator. FIG. 7 depicts the measured angular distribution of the ion beam 84 current expressed as a percentage of the whole beam current for one geometry of the ion source 10 during operation on argon.

The ion source 10 insulated channel 43 can be made up from an assembly of several parts or it can be a single component as shown in FIG. 1. As an assembly of several parts, the insulated channel 43 can be disassembled into its individual parts for cleaning and or replacement. This feature is important for ground based plasma processing applications of the ion source 10 where reactive gases and sputtered products in and around the ion source 10 can, in time, adversely effect the insulating properties and mechanical integrity of the insulated channel 43. For space propulsion applications, a single piece insulated channel 43 is preferred because heat deposited along the interior channel 13 surfaces from the gas ionization and acceleration processes is more readily conducted through the channel insulator thickness to the ring insulator covers 46 and 47 over the inner pole piece 19 and outer pole piece 20, respectively, for radiative cooling to space.

Considerations for use of the ion source 10 for ground based plasma processing applications and for space based spacecraft propulsion applications are material selection and lifetime of the various ion source 10 components. For ground based applications low cost and durability in harsh operating environments are key considerations and the permanent magnet circuit 14 could be made of magnetic permeable 400 series stainless steel with the permanent magnets 21 made from Alnico V or similar low cost, high use temperature magnet material. Also, for ground based applications, the anode/manifold 11 could be made from a non-magnetic 300 series stainless steel, the insulated channel 43 from high purity alumina, and the keeper electrode 30 from a low sputter yield refractory material such as graphite, molybdenum, tantalum or tungsten. However, for space based spacecraft propulsion applications key considerations are high ion source 10 input power and thrust density and minimal mass, and thus the permanent magnet circuit 14 could be made from a low density, high magnetic permeable alloy with the permanent magnets 21 made from a high energy product rare earth magnet material. In addition, for high power density space based propulsion applications, the anode/manifold 11 could be made from titanium or refractory metals and alloys of molybdenum, tantalum or tungsten, the insulated channel 43 from pyrolytic boron nitride, and the keeper electrode 30 from a low sputter yield refractory material such as graphite, molybdenum, tantalum or tungsten. While radiation shielding between the hot insulated channel 43 and the permanent magnets 21 would generally be undesirable for ground based applications due to the demands for absolute processing cleanliness, such multilayer foil shielding could be used for space based propulsion applications of the ion source 10 to prevent high energy product rare earth permanent magnets from becoming too hot and deteriorating in performance.

Repeated testing of the ion source 10 has revealed only very slight erosion of the channel insulator 43 when alumina was used in its construction. Such erosion is a result of ion bombardment on interior surfaces of the channel 13 due to slightly diverging potential gradients in the channel 13 and can be mitigated by precise shaping of the inner pole piece 19 and outer pole piece 20. Similarly, such slight erosion can also be mitigated by the use of more durable channel insulator 43 materials such as pyrolytic boron nitride, hot pressed boron nitride, and composites of these and other similarly durable materials. Hollow cathode 12 erosion in the ion source 10 appears to be negligible. No other ion source 10 erosion processes have been noted.

Operation of the ion source 10 using only the discharge supply 64 is highly desirable for space propulsion applications of the ion source 10 because it means a minimum of electrical power is being used to maintain ion source 10 operation which means that the ion source 10 is operating most efficiently. Also, the capability of ion source 10 operation on only one power supply means that a propulsion system manufactured using the ion source 10 will have fewer components resulting in a higher reliability, smaller mass and lower cost. The embedded central location of the hollow cathode 12 within the ion source 10 permits operation of the ion source 10 using only the discharge supply 64 once the hollow cathode 12 electron emission 80 becomes great enough to result in hollow cathode 12 self-heating. For a 10 cm overall diameter ion source 10, this self-heating condition is attained when the hollow cathode 12 electron emission current 80 is greater than about 2.0 ampere. With the hollow cathode 12 operating in a self-heating mode the heater power supply 60 and the keeper power supply 63 may be shut off. Consequently, depending upon the type of hollow cathode used, it is possible to design the discharge supply 64 so that it provides power to heat the hollow cathode 12 and a high voltage pulse to ignite the keeper and channel plasma discharges. The discharge supply 64 being set up so that the hollow cathode 12 goes into a self-heating mode immediately after ion source 10 start-up so that the hollow cathode 12 heating function of the discharge supply 64 and the starting voltage pulse function of the discharge supply 64 are no longer required.

Although a particular embodiment of the invention has been described with some degree of specificity, it is understood that the present disclosure has been made by way of descriptive example and that the few alternatives that have been mentioned do not constitute the totality of the changes in the details of construction and the combination and arrangement of parts which may be resorted to by those skilled in the art without departing from the true spirit and scope of that which is patentable.

I claim:

1. An ion source comprising:

means for introducing a gas, ionizable to produce a plasma, into a closed figure channel within the ion source;

means within the ion source for establishing, within the closed figure channel, a magnetic field that is predominantly transverse to the axial orientation of the closed figure channel, said means for establishing a magnetic field comprising a permanent magnet circuit, the permanent magnet circuit including one or more permanent magnets comprising a selected one of rods, bars, sectors, and thin rings, the one or more permanent magnets being magnetized in a longitudinal direction and being aligned external to the outer boundary of the closed figure channel, the one or more permanent magnets being magnetized along an axial direction thereof, and the location of the one or more permanent magnets being a selected one of around the outer boundary of the closed figure channel, around the inner boundary of the closed figure channel, and both around the outer boundary of the closed figure channel and around the inner boundary of the closed figure channel, the one or more permanent magnets being positioned within a ferromagnetic material to shape and control a distribution of strength of the magnetic field produced thereby, the ferromagnetic material exhibiting a relative permeability of at least two orders of magnitude greater than unity;

means for orienting the magnetic field to present a first common magnetic pole outside an outer boundary of the closed figure channel and a second common magnetic pole inside an inner boundary of the closed figure channel, both common magnetic poles being located at an open end of the closed figure channel, and both common magnetic poles being of opposite polarity;

means for concentrating the magnetic field at an exit of the closed figure channel;

a hollow cathode and a keeper electrode disposed within the ion source and within an inner boundary of the closed figure channel proximate an open end of the closed figure channel;

means for introducing a gas, ionizable to produce a plasma, into the hollow cathode;

means for establishing a potential difference between the hollow cathode and the keeper electrode to produce a plasma discharge between the hollow cathode and the keeper electrode;

means for impressing a potential difference between the hollow cathode and an anode located at a closed end of the closed figure channel to produce electrons flowing from the hollow cathode and the keeper electrode plasma discharge in a generally 180 degree path to the anode in bombardment of the gas to create a plasma discharge in the closed figure channel; and means for allowing electrons from the hollow cathode and the keeper electrode plasma discharge to flow into an ion beam emanating from the closed figure channel to thereby space-charge neutralize the ion beam.

2. An ion source as in claim 1 wherein:

the means for introducing the gas into the closed figure channel includes manifold means integral to the anode for admitting and ensuring uniformity of a gas pressure and flow rate into the closed figure channel;

the integral anode and manifold means comprises a high electrical conductivity material;

at least one gas inlet line is provided to the integral anode and manifold means;

the integral anode and manifold means is shaped to follow the closed figure channel;

the integral anode and manifold means includes two plenums, separated by a diaphragm;

the diaphragm includes uniformly spaced holes therein of a diameter less than an interior diameter of at least one gas inlet line, the diaphragm having no holes in axial alignment with the gas inlet;

an outer surface of the integral anode and manifold means facing the open end of the closed figure channel includes uniformly spaced holes of comparable diameter to that of the holes in the diaphragm, the outer surface having no holes aligned axially with the holes in the diaphragm; and the outer surface of the integral anode and manifold means is oriented to admit gas into the closed figure channel in a selected one of a predominately axial flow pattern and a predominately spiral flow pattern.

3. An ion source as in claim 2 wherein the means of introducing the gas into the integral anode and manifold means and the closed figure channel includes a means for controlling a distribution of the gas in order to control the density of the plasma discharge between the integral anode and manifold means and the hollow cathode, and thereby control the potential difference between the integral anode and manifold means and the hollow cathode, and thereby control an energy of the ion beam.

4. An ion source as in claim 2, wherein:

the integral anode and manifold means comprises thin, shaped projections attached to the outer surface of the integral anode and manifold means facing the open end of the closed figure channel.

5. An ion source as in claim 1 further comprising closed figure pole pieces of ferromagnetic material positioned around the inside boundary of the closed figure channel and around the outside boundary of the closed figure channel at a location proximate the open end of the closed figure channel.

6. An ion source as in claim 5 wherein the closed figure pole pieces are shaped to provide a concentration of magnetic flux in a direction predominately transverse to a longitudinal direction of the closed figure channel.

7. An ion source as in claim 6 wherein the closed figure pole pieces are formed to create specific shapings of a concentrated magnetic flux in the closed figure channel to effect gas ionization, ion acceleration and ion beam focusing by directing the ions relative to an interior surface of the closed figure channel and by concentrating an ion accelerating potential distribution in the closed figure channel by controlling an axial gradient of the concentrated magnetic flux in the closed figure channel.

8. An ion source as in claim 5 wherein:

the closed figure channel is fabricated to include integral insulator sections for covering an otherwise exposed surface of the closed figure pole pieces and for covering a major portion of an otherwise exposed surface of the keeper electrode.

9. An ion source as in claim 5 wherein the closed figure channel extends in a direction of the ion beam flow beyond the closed figure pole pieces to maximize conversion of the gas into ions.

10. An ion source as in claim 5 wherein the closed figure channel extends in a direction of the ion beam flow beyond the closed figure pole pieces to minimize interception of the ions onto an interior surface of the closed figure channel.

11. An ion source as in claim 1 wherein:

the hollow cathode is positioned at a location along an axis of the ion source that lies between the closed end of the closed figure channel and the open end of the closed figure channel.

12. An ion source as in claim 1 wherein the closed figure channel encompasses elongated race track closed figure channel geometries, resulting in a linear channel length equal to a least twice a width of the closed figure channel.

13. An ion source as in claim 1 comprising one or more additional hollow cathodes and keeper electrodes positioned within the inner boundary of the closed figure channel.

14. An ion source as in claim 1 wherein the one or more permanent magnets are magnetized uniformly so that the azimuthal variation in the magnetic field strength at the location of the greatest field concentration between the closed figure pole pieces varies by less than ±5%.

15. An ion source as in claim 1 further comprising means for adjusting a strength of the magnetic field to alter the ion beam energy and a current of the ion beam.

16. An ion source as in claim 1 further comprising power supply means for supplying a heater power to the hollow cathode and a keep-alive current to the keeper electrode which may be reduced to zero after establishing a self-heating effect on the hollow cathode.

17. An ion source as in claim 16 further comprising a single discharge supply to sustain ion source operation following reduction to zero of the heater power to the hollow cathode and the keep-alive current to the keeper electrode.

18. An ion source as in claim 1 wherein the closed figure channel is fabricated of thin sections of electrical insulator material that is resistant to ion sputter erosion in a direction generally corresponding to the general direction of ions bombarding said electrical insulator material.

19. An ion source as in claim 18 wherein the closed figure channel is fabricated of a selected one of high purity alumina, hot pressed boron nitride, pyrolytic boron nitride, and composites thereof that are fabricated to have a high resistance of ion sputter erosion in a preferred direction and a high thermal conductivity in a preferred direction.

20. An ion source as in claim 18 wherein the closed figure channel is fabricated as a selected one of a monolithic part and a series of readily disassembled sections.

* * * * *